United States Patent [19]

Hepworth et al.

[11] 3,957,098

[45] May 18, 1976

[54] EROSION CONTROL BAG

[75] Inventors: George Hepworth, Palm Beach; Joseph F. Kelly, Miami, both of Fla.

[73] Assignee: Erosion Control Incorporated, West Palm Beach, Fla.

[22] Filed: June 26, 1972

[21] Appl. No.: 266,177

Related U.S. Application Data

[63] Continuation-in-part of Ser. No. 31,955, Apr. 27, 1970, abandoned.

[52] U.S. Cl. ..... 150/9; 61/37; 150/1; 260/2.5 M

[51] Int. Cl. ..... B65d 33/16

[58] Field of Search ..... 150/1, 9; 229/62.5, 229/53; 260/2.5 M; 61/38, 37

[56] References Cited

UNITED STATES PATENTS

| | | | |
|---|---|---|---|
| 2,119,895 | 6/1938 | Sutton | 150/9 X |
| 3,340,919 | 9/1967 | Holbrook | 150/1 |

FOREIGN PATENTS OR APPLICATIONS

| | | | |
|---|---|---|---|
| 1,020,719 | 2/1966 | United Kingdom | 150/1 |

*Primary Examiner*—William I. Price
*Assistant Examiner*—Stephen P. Garbe
*Attorney, Agent, or Firm*—Seidel, Gonda & Goldhammer

[57] ABSTRACT

An erosion control bag of dark-colored fabric for underwater use and light-colored for other use is disclosed having a porosity of 10 to 35 cubic feet per minute so that air and water may escape from the bag as water and a filler are pumped into the bag. The bag has a self-sealing opening so that it can be filled while positioned in situ below water level.

10 Claims, 4 Drawing Figures

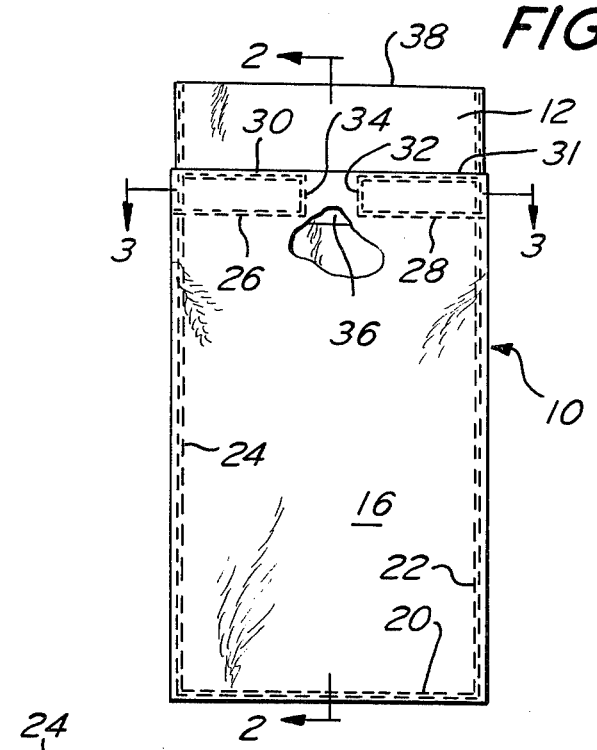
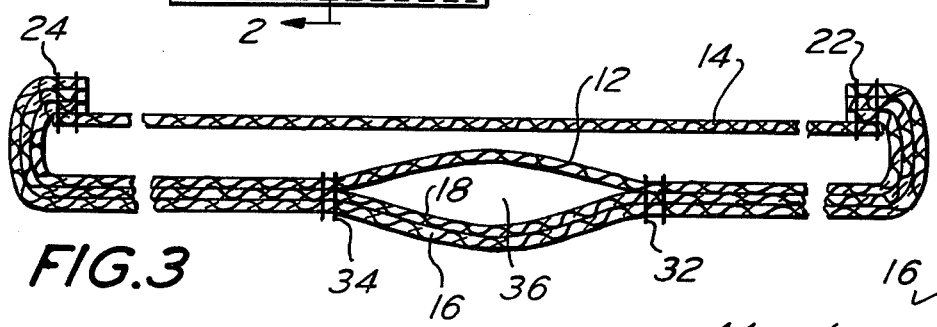
FIG. 3
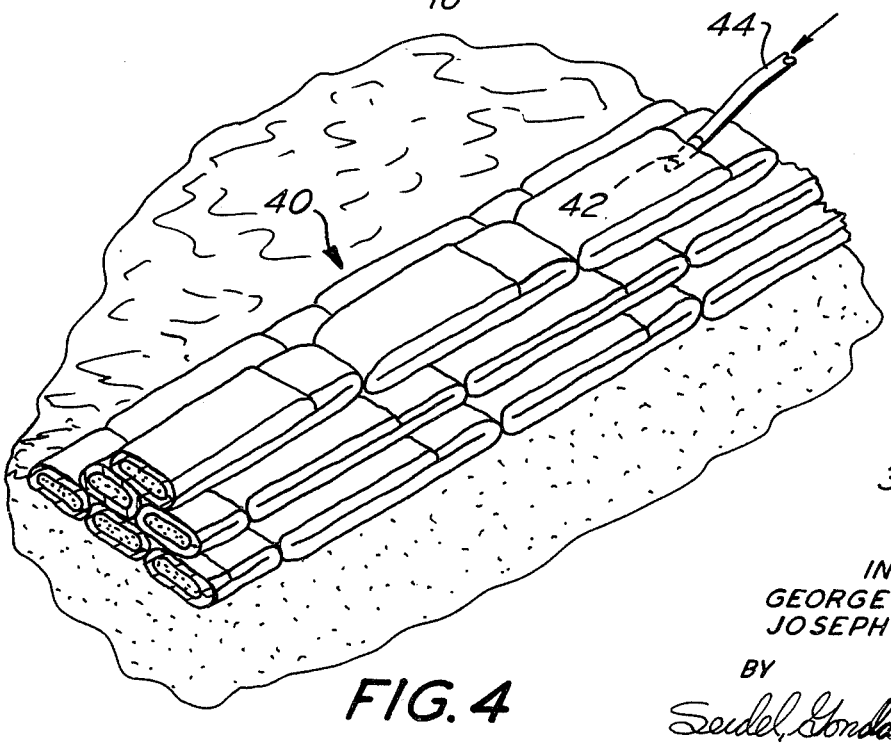
FIG. 4
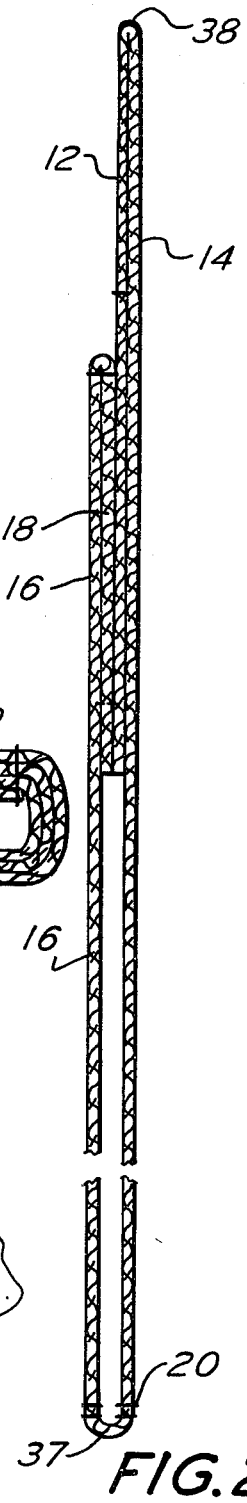
FIG. 2
INVENTORS
GEORGE HEPWORTH
JOSEPH F. KELLY
BY
Seidel, Gonda & Goldhammer
ATTORNEYS.

EROSION CONTROL BAG

This application is a continuation-in-part of our copending application Ser. No. 031,955 filed Apr. 27, 1970 now abandoned and entitled EROSION CONTROL BAG.

This invention relates to an erosion control bag, and more particularly, to a bag which may be utilized to control erosion of beaches, stream banks, construct artificial reefs for shorelines or flood control, etc. The bag of the present invention is constructed in a novel manner whereby it may be filled in situ below water level.

The erosion control bag of the present invention is preferably a dark-colored synthetic fabric such as black nylon, polypropylene, polyesters, and the like for underwater use. The bags are substantially longer than their width. Actual bags have a length of 10 feet and a width of 5 feet. Bags of greater or lesser length or width may be utilized.

The bags of the present invention are closed at both ends. The fabric has a porosity of between 10 and 35 cubic feet per minute so that any air and/or water within the bag may escape from the bag at the same rate that water and/or a filler is pumped into the bag. The filler may be sand, gravel, cement, etc.

In order that the water and filler may be pumped into the bag while the bag is disposed in situ above or below water level, the bag is provided with a nozzle opening spaced from the ends of the bag. A nozzle connected to a pump by means of a conduit is adapted to extend into the nozzle opening. The nozzle opening is preferably made by overlapping two layers of the fabric and stitching or heat sealing them together by spaced seams so as to leave a centrally disposed unstitched portion which defines the nozzle opening. All stitching of the bag is preferably double-stitching with 4 to 6½ stitches per inch so as not to materially change the porosity of the side edges of the bag. In order to have permanency of the stitching, the stitching is preferably a lock stitch.

It is an object of the present invention to provide a novel erosion control bag.

It is another object of the present invention to provide an erosion control bag which can be filled in situ below water level.

It is another object of the present invention to provide an erosion control bag which does not require movement of the bag after filling and which does not require any stitching or closing of the bag after filling.

It is another object of the present invention to provide an erosion control reef of pyramid-stacked erosion control bags which may be filled in situ below water level.

It is another object of the present invention to provide an erosion control bag which is simple, inexpensive, and reliable as an artificial reef.

Other objects will appear hereinafter.

For the purpose of illustrating the invention, there is shown in the drawings a form which is presently preferred; it being understood, however, that this invention is not limited to the precise arrangements and instrumentalities shown.

FIG. 1 is a plan view of the erosion control bag of the present invention.

FIG. 2 is a sectional view taken along the line 2—2 in FIG. 1 but on an enlarged scale.

FIG. 3 is a sectional view taken along the line 3—3 in FIG. 1 but on an enlarged scale.

FIG. 4 is a partial perspective view of an artificial reef constructed by pyramiding bags in accordance with the present invention.

Referring to the drawing in detail, wherein like numerals indicate like elements, there is shown in FIG. 1 an erosion control bag designated generally as 10. The bag 10, when used underwater, is comprised of a colored synthetic fabric made from a variety of materials such as nylon, Dacron, polypropylene, polyester, etc. Bags made from such materials may be disposed below water level for long periods of time without deteriorating. The fabric of the bag 10 is preferably a dark or black color for underwater use. When bag 10 is used on beaches, it is preferably a light color so as to reflect heat.

The fabric from which the bag 10 is made may be dope dyed after the fabric is made or the filaments from which the bag is made may be dyed. Suitable bag material of nylon is 26 warp ends per inch and 26 filling picks per inch or 28 warp ends per inch and 28 filling ends per inch if dope dyed yarn is the component. The fabric is made so as to have a porosity of between 10 and 35 cubic feet per minute. The porosity may be as high as 50 cubic feet per minute.

In the preferred embodiment, the fabric for bag 10 is woven from filaments which have been coated with a polymeric coating such as polyvinyl chloride, Teflon (trademark), acrylic compounds, etc. This permits more precise control over porosity, improves tear strength, and provides encapsulation of the filaments or bundles of filaments especially at the point of interlacing of the warp and filling threads. The coating is sufficiently thick so that the denier of the filaments is increased at least 30 percent. By way of example, nylon filaments having a denier of 840 were coated with polyvinyl chloride to increase denier to about 1,100. Suitable fabric could have 16 to 24 ends and picks (warp and fill) per square inch. The color of the coating is preferably light-colored such as white or sand color for beach use and can be dark for underwater use.

Referring to FIGS. 1–3 of the drawing, it will be noted that the bag 10 is made from fabric wherein layer 12 is overlapped on itself so as to have a layer 14 parallel thereto. Layer 14 is then overlapped on itself so as to have a layer 16 parallel thereto. Layer 16 is overlapped on itself so as to define layer 18. Layer 18 overlies and is in contact with layer 12. Layer 16 partially overlies layer 12.

The ends 37 and 38 of the bag are closed. Seams or joints may be heat sealed or stitched. If desired, stitching 20 may be provided along the ends. Stitching 20 and all of the stitching to be referred to hereinafter is preferably double stitching with 4 to 6½ stitches per inch so as not to change the porosity of the side edges of the bag 10. Two sets of stitching or joints are provided as shown more clearly in FIG. 1 so as to define at least one nozzle opening 36. One set of stitching is defined by the stitching 28, 31 and 32 so as to extend from the side stitching 22 in the form of a U-shaped stitching. The second set of stitching is defined by the numerals 26, 30 and 34 which extend toward the first set, is U-shaped, and extends from the side stitching 24.

As shown more clearly in FIG. 3, the side stitching 22 and 24 extends through all four layers of the fabric in the zone of the two sets of U-shaped stitching. The stitching 32 and 34 is spaced from one another so as to define the side edges of the nozzle opening 36. The length of the nozzle opening 36 is defined by the length of stitching 32 and 34.

The nozzle opening 36 is spaced from end 38 by a substantial distance. The distance of the nozzle opening 36 from the end 38 is preferably between 8 and 30 inches. The width of the nozzle openings 36 should be less than one-third the bag width. All stitching referred to above is a lock stitch so as to prevent unravelling of the bag and render it tamperproof.

In FIG. 4, there is illustrated an erosion control reef designated generally as 40. The reef 40 comprises a plurality of bags 10 disposed side-by-side and filled with a filler such as sand. Additional bags placed on top of the first layer of bags are located so as to form a pyramid of the reef. The pyramiding configuration of the reef substantially reduces the effect of waves. The bags are filled from 85 to 100 percent of capacity while disposed in situ above or below water level. No stitching or moving of the bags is necessary after the bags are filled. The bags are filled in situ by means of nozzle 42 which extends through the nozzle opening 36. Nozzle 42 is connected to a flexible conduit 44 connected to a pump. The filler material delivered by the pump may be the sand, gravel, and other material immediately adjacent to the location of the reef 40. In order for the bag to properly balloon when the water and filler are pumped thereinto by way of nozzle 42, it has been ascertained that the bag 10 must have a porosity between 10 and 50 cubic feet per minute to insure discharge of water through the bag when water and filler material are pumped into the bag. When the porosity of the bag 10 is below 10, the water does not escape fast enough whereby the sand will back out through the nozzle opening. If the porosity of the bag 10 is greater than 50, the water and filler material exit through the bag. We have found that the length of the nozzle opening 36 should be at least 8 inches long.

For purposes of illustration, the bag 10 in accordance with a working embodiment had a length of 10 feet, a width of 5 feet, and the distance from the nozzle opening to end 38 was 15 inches. The nozzle opening 36 had a width of 10 inches and a length of 8 inches. All seams were double seams with 4½ stitches per inch.

When less than 4½ stitches per inch were used, the bag had insufficient strength and the porosity was increased beyond the desired operative range indicated above. When the bag 10 has more than 6 stitches per inch, the porosity of the bag was below the above-indicated range and the bag was too weak.

The filaments of the fabric are preferably coated with the above-mentioned polymeric materials so as to provide a coating which resists ultraviolet and infrared rays, mildew, and leeching. Thus, by way of example, a polyvinyl chloride coating is used having the following inhibitors: stabilized against ultraviolet rays by using a substituted benzophenone and titanium dioxide, stabilized against mildew and bacteria by using triphenyltin monophenoxide, and stabilized against fresh and salt water leeching by using a blend of known polymeric plasticizers.

The fabric or yarn used to construct the bag 10 is preferably stretched and heat-seat before making the bags so that the bag will not elongate in use. Since the sand or other filler material will be above and below the location of the nozzle opening 36, the bag has a self-sealing characteristic.

The above-indicated porosity range for the fabric is based on ASTM and ASTM Testing Method 737–46, Air Permeability of Textile Products, wherein the porosity in cubic feet per minute is per square foot of fabric at a pressure drop of 0.5 inches of water. The thread for the stitching above should have a tenacity equal to that of the strongest component yarn in the warp and fill.

The present invention may be embodied in other specific forms without departing from the spirit or essential attributes thereof and, accordingly, reference should be made to the appended claims, rather than to the foregoing specification as indicating the scope of the invention.

We claim:

1. An erosion control bag comprising a bag of dark-colored fabric having a length substantially greater than its width, and closed at both ends, said fabric having a porosity of 10 to 35 cubic feet per minute, means defining a nozzle opening spaced from the ends of the bag and through which a nozzle may extend to introduce water and a filler, said nozzle opening being closer to one end of the bag than the other, said means including two overlapping layers of fabric stitched together by spaced sets of stitching leaving an unstitched portion which defines the nozzle opening in the central portion spaced from the side edges of the bag.

2. An erosion control bag in accordance with claim 1 wherein said bag is stitched along its side edges, all of said stitching being double stitching with 4 to 6½ stitches per inch.

3. A bag in accordance with claim 1 wherein said fabric is a synthetic fabric selected from the group consisting of nylon, polypropylene, and polyesters.

4. An erosion control bag in accordance with claim 1 wherein the nozzle opening is positioned at a location from its adjacent end by a distance of approximately 1/8 the total length of the bag, and said bag having a length approximately twice its width.

5. An erosion control bag in accordance with claim 4 wherein said nozzle opening has a length of approximately 8 inches.

6. An erosion control bag of nylon fabric, said bag having a length approximately twice its width, both ends of said bag being closed, said fabric having a porosity of between 10 to 35 cubic feet per minute, means defining a nozzle opening spaced from one end of said bag by a distance of between 8 and 30 inches, two overlapping layers of said fabric being stitched together by spaced sets of stitching, thereby leaving an unstitched central portion which defines the nozzle opening, said nozzle opening having a length of approximately 8 inches, side edges of said bag being stitched together, all of said stitching being double lock stitches with 4 to 6½ stitches per inch.

7. An erosion control device comprising a bag made from a synthetic fabric having a length substantially greater than its width, said fabric being woven from filaments or bundles of filaments having a discrete coating of a polymeric plastic material, said bag being closed at both ends and having seams along its side edges, said bag being made from a fabric having a porosity of 10 to 50 cubic feet per minute, means defining a nozzle opening spaced from an end of said bag through which water and a filler may be pumped into the bag, said means including two overlapping layers of fabric joined together by spaced sets of seams leaving a portion which defines a nozzle opening.

8. An erosion control device in accordance with claim 7 wherein said polymeric plastic material is sufficiently thick so as to increase the denier of the filament or bundle of filaments at least 30 percent.

9. An erosion control device in accordance with claim 8 wherein said polymeric plastic material is light in color and includes an inhibitor to retard degradation of the synthetic fabric due to ultraviolet rays.

10. An erosion control device in accordance with claim 9 wherein the synthetic fabric is selected from the group consisting of nylon, polypropylene and polyester.

* * * * *